United States Patent [19]

Häberle

[11] 4,304,178

[45] Dec. 8, 1981

[54] SPACER FOR INTERPOSITION BETWEEN A TEMPERATURE-CONTROLLED PLATE AND A PRESSURE PLATE OF A PRESS

[75] Inventor: Hans Häberle, Senden, Fed. Rep. of Germany

[73] Assignee: Lenser Kunststoff-Presswerk GmbH & Co. KG, Senden, Fed. Rep. of Germany

[21] Appl. No.: 143,599

[22] Filed: Apr. 25, 1980

[30] Foreign Application Priority Data

Apr. 28, 1979 [DE] Fed. Rep. of Germany ... 7912427[U]

[51] Int. Cl.[3] ..... B30B 15/28; B30B 15/34; B30B 15/06

[52] U.S. Cl. ..... 100/93 P; 100/295; 425/407; 425/384; 219/243; 156/583.1

[58] Field of Search ..... 100/93 P, 295; 425/407, 425/411, 384; 156/583.1, 583.6–583.9; 219/243

[56] References Cited

U.S. PATENT DOCUMENTS

| | | | |
|---|---|---|---|
| 2,624,389 | 1/1953 | Bungay | 100/93 P |
| 3,985,491 | 10/1976 | King | 425/384 |
| 4,113,909 | 9/1978 | Beasley | 100/295 X |
| 4,193,341 | 3/1980 | Clements et al. | 100/93 P |

FOREIGN PATENT DOCUMENTS

| | | | |
|---|---|---|---|
| 2354281 | 5/1974 | Fed. Rep. of Germany . | |
| 2415178 | 10/1975 | Fed. Rep. of Germany | 100/93 P |

*Primary Examiner*—Peter Feldman
*Attorney, Agent, or Firm*—Karl F. Ross

[57] ABSTRACT

Temperature-controlled press plates are spaced apart from the pressure plates of a press by spacers which limit the heat flow from the temperature-controlled plate to the pressure plate and vice versa. The spacers comprise cupshaped members for a pin received in a bore of one of the plates, the recess of the cup accommodating an insulating layer which is compression resistant and carries a friction-reducing layer against which the surface of the other plate bears.

6 Claims, 2 Drawing Figures

SPACER FOR INTERPOSITION BETWEEN A TEMPERATURE-CONTROLLED PLATE AND A PRESSURE PLATE OF A PRESS

FIELD OF THE INVENTION

My present invention relates to temperature-controlled presses and, more particularly, to presses of the type in which a temperature-controlled plate is interposed between the material to be compressed and a pressure plate, the latter being the bed or head of the press. More specifically, my invention relates to a spacer adapted to be interposed between the heatable and/or coolable plate and its pressure plate, and to press assemblies including such spacers.

BACKGROUND OF THE INVENTION

In the hot pressing of synthetic resin foils, sheets or like members, it is a common practice to interpose between the deformable synthetic resin material and a pressure plate, which may be the hydraulically movable bed or head of the press, a heatable and/or coolable plate, hereinafter referred to as the temperature-controlled or press plate.

The latter plate may be raised to a temperature equal to or above the softening point of the synthetic resin by circulating a heating fluid therethrough, or can be electrically heated. In the application described it is also desirable that the temperature-controlled plate be cooled while the pressure is applied or thereafter to harden the workpiece. The cooling can also be effected by passing a fluid through passages in the temperature-controlled plate.

In other hot-pressing applications, e.g. in the production of pressed board or for laminating purposes, either heating alone or a combination of heating and cooling can be used, the temperature-controlled plate serving for this purpose.

It is known to limit the heat flow to and from the temperature-controlled plate and from the adjoining pressure plate or into the latter by interposing between the pressure plate a plurality of spacers which provide thermal insulation and act as force-transmitting members allowing the press pressure to be applied to the temperature-controlled plate and then the material to be compressed.

These spacers have a dual function, therefore, in that they not only limit heat flow between the pressure plate and the temperature-controlled plate, while acting as force-transmitting members, but they permit dimensional change because of thermal phenomena, e.g. expansion and contraction of the temperature-controlled plate with minimum wear of contact surfaces between the temperature-controlled plate and the pressure plate.

Without such wear reduction, the damage to the press plate is usually so pronounced that the operating life of the press is severely limited.

Furthermore, the spacers minimize the distortion of the press plates in the closed state of the press, i.e. when the press pressure is effective and thereby prevent damage to the workpiece which is especially important in the case of shaping plastic members.

The spacers have been provided in various configurations heretofore and reference may be made especially to the German patent document (Offenlegungsschrift) DE-OS No. 2,354,281 in which the spacers are massive bodies of filled polyamide with a height/diameter ratio less than 1. These spacers are provided in openings of a shield or barrier of thermally insulating material, the thickness of this layer being less than the height of the spacer.

The shield or barrier layer can be composed of wood cement. These constructions have been found to be satisfactory only for relatively small capacity presses, i.e. presses whose play area is limited. In such presses the movement of the temperature-controlled plate relative to the pressure plate is comparatively small.

For large-format presses, however, in which the relative displacement of the two plates because of their temperature difference is relatively high these comparatively large movements can result in entrainment of the spacers, distortion of the shield and nonuniform distribution of force over the surface of the temperature-controlled plate. Because of the nonuniform force distribution at high-plate pressures, plate deformation can occur with obvious production disadvantages and possible permanent damage to the press members.

To avoid these disadvantages it is not uncommon for the operator to reposition the spacers between press operations at considerable labor expense by time-consuming procedures.

OBJECTS OF THE INVENTION

It is the principal object of the present invention to provide an improved spacer system between the temperature-controlled plate and pressure plate of a press which will obviate the disadvantages of earlier systems and, more specifically, will limit heat transfer between the plates while permitting relative movement of the plates parallel to their juxtaposed surfaces without altering the distribution of spacers.

Another object of the invention is to provide a spacer for the purposes described which will improve the operating life of the press by limiting wear of the relative moving parts between temperature-controlled plate and pressure plate of the press.

Yet another object of the invention is to provide a low cost spacer which is capable of being introduced into the space between the temperature-controlled plate and pressure plate of a press in a simple and rapid manner and which can sensitively adjust to the spacing between these plates so that the relative orientations of the plates can be established with a high degree of accuracy and without the danger that this orientation and spacing will change because of the heating and cooling of the temperature-controlled plate.

SUMMARY OF THE INVENTION

These objects and others which will become apparent hereinafter are attained, in accordance with the present invention, in a press having at least one pressure plate and at least one temperature-controlled plate, with spacers interposed between these plates and distributed over the space between them, each of the spacers comprising a cup-shaped socket member formed with a pin which is received in a bore or recess of one of the plates and has its cup recess open in the direction of the other plate and receiving an insulating disk and a spacer disk. The insulating disk is composed of a thermally insulating material which is both refractory and compression resistant, and has a thickness which is less than the internal height of the cup recess. The spacer disk which is provided between the insulating disk and the other plate, has a thickness greater than the remaining height of the recess and is composed of a metal of low coefficient of sliding friction and high wear resistance, the latter disk projecting out of the cup and contacting the aforementioned other plate.

The anchoring of the socket-forming member by a pin or boss in a respective bore of one of the plates precludes uncontrolled movement or entrainment of the spacers during displacement of the other plate parallel to the juxtaposed surfaces because of the temperature differential. In other words, the distribution of the spacers remains constant because each spacer is fixed in place on the first mentioned plate.

Since the contact surface between each spacer and the other plate is formed by a low friction, wear-resistant metal disk, the wear on either the spacer or the other plate is minimized and practically no shear stress arises at the interface. Consequently, the spacers remain largely undeformed even with a large number of press cycles and the operating life of the press is markedly increased.

The low-friction metal disks form meager heat bridges to the other plate, the heat flow being largely precluded by the insulating disk within the cups.

Furthermore, since each insulating disk or even the low-friction metal disks themselves can be made up of a multiplicity of separately introduced layers which can function as shims, each spacer can be adjusted to the gap between the plates at a particular location without difficulty. These layers can be of a thickness of, say, 1/10 of a millimeter for high precision. Naturally, the insulating or low-friction bearing disks can also be made in various standard thicknesses, differing by, say, 1/10 of a millimeter so that the proper thickness disks can be readily selected for a particular plate spacing.

Preferably the bores for the pins are provided in the pressure plate, this having the advantage that one can machine the bores in the pressure plate without having to be concerned for the locations of the fluid passages in the temperature-controlled plate. Furthermore, the pressure plate is subjected to smaller temperature changes than the lengths of the pins so that the sockets bear against the press plates only by their annular shoulders surrounding the pins. This bearing surface can be independent of the bearing surface of the low-friction disk upon the other plate, thereby allowing the force distribution to be controlled within wide limits.

For example if the force distribution requirements necessitated a bearing surface against a low-friction member which is relatively large, this can be accomplished without inordinately increasing the bearing surface of the annular shoulder against the first-mentioned plate. When this surface is minimized, naturally, the heat flow to the socket is likewise reduced.

It has been found to be advantageous, moreover, to provide a layer of corrosion-resistant (stainless) steel between the other plate and the low-friction disks of the spacers, this sheet, foil or layer of stainless steel being fixed to the other plate.

The manner in which the stainless steel layer is fixed to the other plate is not material to the invention. However, it has been found that this layer further reduces wear and reduces deterioration of the plate.

Best results are obtained when the bearing disk of the spacer, i.e. the low-wear, low-friction metal disk, is a spherulitic gray cast iron such as GGG 50, a metal having self-lubricating properties, while the insulating disk is composed of asbestos board having a high compressive strength.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
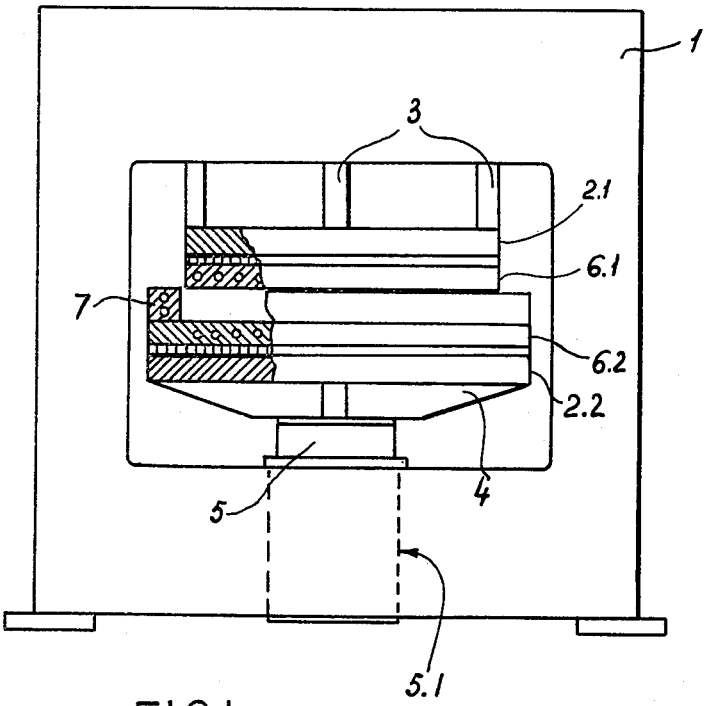
FIG. 1 is a diagrammatic vertical elevationsl view of a press according to the invention.

The press shown in FIG. 1 can be a forming press for the shaping, embossing or patterning of synthetic resin plates, foils or sheets and comprises a press frame 1.

An upper pressure plate 2.1 is mounted on the upper traverse of the frame by spacing bodies 3 in a conventional manner while the lower pressure plate 2.2, forming the bed of the press, is mounted upon a press table 4 on a cylinder 5 of a hydraulic piston-and-cylinder arrangement 5.1 fixed in the lower frame traverse.

Hydraulic actuation of the cylinder arrangement 5.1 opens and closes the press and applies the press pressure.

The lower pressure plate 2.2 carries the lower press plate 6.2 which can be provided with a lateral shaping frame 7 and forms a temperature-controlled plate provided with passage 8 for the heating and cooling fluid.

Similarly, the upper pressure plate 2.1 is juxtaposed on its underside with an upper press plate 6.1 which, again, is a temperature-controlled plate having passages for the fluid.

The press as shown in FIG. 1 is in its open position and can receive the workpiece between the press plates 6.1 and 6.2 within the frame 7.

Figure 2:
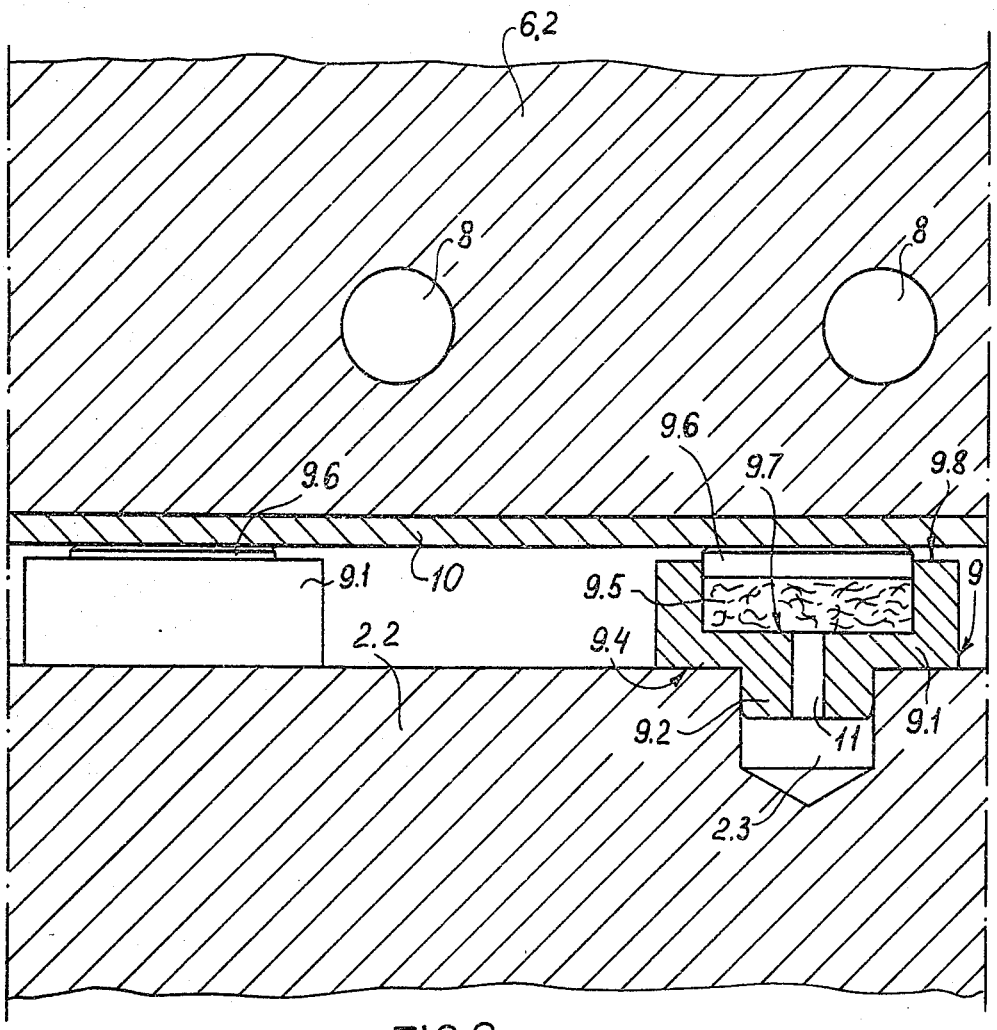
FIG. 2 is a cross-sectional view taken through a portion of the press showing the relationship between the spacer of the invention and the press plates.

As will be apparent from FIG. 2, between each press plate 6.1 or 6.2 and the respective pressure plate 2.1, 2.2 is a multiplicity of spacers 9 in a surface array allowing uniform force transmission between the plates.

The spacers 9 each comprise a cup-shaped socket member 9.1 mounted on one of the mutually juxtaposed plates, usually the pressure plate 2.1 or 2.2, and having a cylindrical recess opening toward the other plate, i.e. the temperature-controlled plate 6.1, 6.2, respectively. Each of these socket members 9.1 receives an insulating disk 9.5 and a spacer disk 9.6. The insulating disc 9.5 is composed of compression-resistant asbestos and has a thickness less than the depth of the recess into which it is fitted. The asbestos insulating disk rests against the bottom 9.7 of the recess.

The spacer disk 9.6 is composed of metal having a low coefficient of sliding friction and high wear resistance, e.g. globular-graphite cast iron (GGG 50) and projects above the upper edge 9.8 of the socket member 9.1.

The latter is formed at its bottom with an axially extending pin or boss 9.2 which is also cylindrical and is received in a respective bore 2.3 of the pressure plate 2.1 or 2.2. The respective press plate 6.1 or 6.2 bears indirectly and freely upon the disks 9.6 of the spacers 9 via stainless steel 10 which is secured to the press plate by any convenient method.

The bores 2.3 have a greater depth than the length of the bosses 9.2.

In the embodiment illustrated, the bores 2.3 are provided in the pressure plates although it is also possible to provide them in the press plates, thereby reversing the orientations of the spacers.

The members 9.1 rest against the plates (e.g. 2.2) to which they are affixed, solely by the annular shoulders 9.4 surrounding the bosses 9.2.

The width or radial dimension of each shoulder can be selected to accommodate the forces to be transferred, independently from the areas of the insulating disks 9.5.

The stainless steel plate 10 can have a thickness of as little as 5 mm and should be anchored sufficiently securely to the press plate to prevent it from warping or bulging.

The combination of the stainless steel layer and the self-lubricating cast iron spacer 9.6 has been found to provide particularly excellent sliding friction characteristics with a minimum of wear and hence minimum downtime of the press.

While the members 9.1 and the insulating disks 9.5 for all of the spacers 9 can have the same dimensions, the thickness of the disk 9.6 can vary from spacer to spacer depending upon the gap width between the plates to be spanned by the spacer. The disks 9.6 may be made available in various sizes in steps of, say 0.1 mm, or the spacer disks 9.6 can be assembled from a stack of shims or the like.

The boss 9.2 is preferably formed with a bore 11 which opens at the bottom 9.7 of the recess so that a tool can be pressed into the socket to dislodge the disks 9.5 and 9.6 should replacement of them be desirable.

Naturally, the upper press plate can be suspended from the upper pressure plate by any conventional means independently of the spacers. In addition, guide means can be provided for guiding the plates during their opening and closing movements in any conventional manner.

I claim:

1. In a press having at least one pressure plate, a temperature-controlled plate spacedly juxtaposed with said pressure plate, and a multiplicity of spacers disposed between said plates for thermally insulating said plates from one another and effecting force transmission between said plates, the improvement wherein one of said plates is provided with a bore for each spacer and each spacer comprises:

a cup-shaped member formed with a recess opening toward the other plate;

a boss formed on said member and received in said bore;

a thermally insulating compression-resistant disk received in said recess and having a thickness less than the depth of said recess; and a low-friction metal spacer disk received in said recess and projecting from said member and in slidable engagement with said other plate.

2. The improvement defined in claim 1 wherein said bores are provided in said pressure plate.

3. The improvement defined in claim 1 wherein each of said bores has an axial length greater than the axial length of the respective boss received therein, whereby each of said members bears upon said one of said plates solely with an annular shoulder surrounding said boss.

4. The improvement defined in claim 1, claim 2 or claim 3, further comprising a stainless steel layer formed on said other plate and engaging said spacer disks.

5. The improvement defined in claim 4 wherein said spacer disks are composed of globular graphite gray cast iron.

6. The improvement defined in claim 1, claim 2 or claim 3, wherein said insulating disks are composed of asbestos.

* * * * *